United States Patent [19]

Boeve et al.

[11] Patent Number: 4,616,821

[45] Date of Patent: Oct. 14, 1986

[54] SHEET IMAGING APPARATUS

[75] Inventors: Gerard J. Boeve; Etienne M. De Cock, both of Edegem, Belgium

[73] Assignee: Agfa-Gevaert N.V., Mortsel, Belgium

[21] Appl. No.: 715,940

[22] Filed: Mar. 25, 1985

[30] Foreign Application Priority Data

Mar. 30, 1984 [EP] European Pat. Off. ..... 84200453.3

[51] Int. Cl.[4] ..... B65H 31/04

[52] U.S. Cl. ..... 271/213; 271/221; 271/238; 355/3 SH; 414/54

[58] Field of Search ..... 271/213, 221, 222, 241, 271/250, 238, 240; 414/54; 355/3 SH, 14 SH

[56] References Cited

U.S. PATENT DOCUMENTS 4,220,323 9/1980 Smith ..... 271/213

4,477,218 10/1984 Bean ..... 271/221

OTHER PUBLICATIONS

IBM Technical Disclosure Bulletin, "Sheet Stacking Technique", by D. F. Manning and J. V. Vetrdue, vol. 17, No. 8, Jan. 1975, p. 2255.

*Primary Examiner*—Bruce H. Stoner, Jr.
*Assistant Examiner*—John A. Carroll
*Attorney, Agent, or Firm*—William J. Daniel

[57] ABSTRACT

A sheet imaging apparatus with a collector tray for receiving sheets discharged from the apparatus. The collecting tray has two stationary side-walls and a sheet-supporting back plate is driven in a reciprocating motion in a transverse direction, whereby two part-stacks of sheets may be produced that are individually accurately aligned by abutment against cooperating fixed abutments.

5 Claims, 5 Drawing Figures

SHEET IMAGING APPARATUS

The present invention relates to sheet imaging apparatus wherein sheets are taken in succession from a supply stack of sheets and are subjected to an image-forming treatment, and wherein the sheets are finally collected stackwise in staggered relationship in a collector tray.

Apparatus of the described kind are known and include copying apparatus, printing apparatus (also known as intelligent printers), etc. In copying apparatus it occurs that a number of copies must be made from one text, and unless a sophisticated apparatus is used which is provided with a sorter, the operator has to remove the produced copies from the collector tray and to sort them one by one. The convenience of the apparatus is increased if a collector tray is used wherein two staggered part-stacks of copies are produced, e.g. the copies of the even numbered pages lying somewhat to the left, and the copies of the odd numbered pages lying somewhat to the right. In the mentioned way, the distinct sets of copies of each page may easily be separated, after which collating of the copies is done. A copying apparatus with a collecting tray capable of taking two positions thereby to produce the effect of staggered part-stacks of copies is disclosed in EU Patent Publication No. A2 0 004 687 entitled "Xerographic copying apparatus for producing double sided copies".

In printing apparatus it occurs likewise that a number of prints must be made from one text. Unlike a copier, a printer can be instructed to produce directly successive complete sets of prints, since the consecutive pages of the complete text can be printed in due order, and this printing is repeated a second time, etc., until the required number of prints has been produced. It is most convenient that the several sets of prints are received in the collecting tray of the apparatus in the form of staggered sets, so that the operator can remove the different sets of prints without any need for counting the pages. The mechanism of the prior art copying apparatus described hereinbefore could be used in a printing apparatus to form part-stacks, but in the latter application the mechanism lacks a feature that would be very desirable, namely the capability to also align the sheets of the part-stacks. The mechanism of the cited EU Application operates to displace the stacks of already received sheets before a following sheet is received on top of the stack. Depending on the friction of the sheets, as well as their tendency to curl, the sheets can undergo slight displacements before they land on the already stacked sheets and although the system is perfectly operative to produce staggered part-stacks that are clearly distinct from each other, the individual sheets of each part-stack are not very well aligned and thus additional work is required before the part-stacks can be stitched, perforated, etc. Furthermore, the stack-displacing mechanism with a screw-thread spindle as shown in the EU Application operates rather slowly so that this technique does not appear very appropriate for use in high speed modern printers wherein the image formation occurs by laser scanning or by means of LED exposure bars.

Another mechanism which operates to produce staggered stacks of sheets is disclosed in U.S. Pat. No. 3,041,065. A paper collator comprises a jogger mechanism for aligning groups of sheets, and a bin that can be laterally shifted for receiving the groups of sheets in staggered relation. The mechanism is not very compact, and the sheets must be stapled prior to their transfer to the bin in order to eliminate relative displacement of the sheets.

It is the object of the present invention to provide a sheet imaging apparatus of the kind referred to, with a simple mechanism for the stacking of discharged sheets in two staggered part-stacks, and wherein the sheets in each part-stack are accurately aligned.

According to the present invention, a sheet imaging apparatus wherein sheets are taken in succession from a supply stack of such sheets, passed through an imaging station wherein an image is formed on the sheets, and then downwardly delivered one by one into a collecting tray, and wherein said collecting tray is provided with a sheet-supporting back plate that is arranged for oscillation or reciprocation in a direction transverse to the direction of sheet delivery, thereby to produce two transversely staggered part-stacks of sheets in the collecting tray, is characterised in that said collecting tray comprises opposed stationary wall means at either lateral side of the sheet supporting plate, and the means for oscillating the sheet-supporting back plate functions in such a way that at each dead point of the oscillation sheets are received on the plate and at the other dead point of oscillation the thus-received sheets are displaced by an abutment against the corresponding stationary wall, thereby to form the part-stacks of sheets.

The sheet supporting back plate may be a solid plate, but it may also be in the form of a surface with ribs or the like, and it may be roughened or treated in an other way in order to increase the frictional contact with the first sheet received.

The width of the sheet supporting back plate can be equal to the width of the discharged sheets, but said back plate can also be narrower than the sheets, or larger provided that its width is smaller than the width of the sheets received thereon plus the desired staggering of the part stacks.

Although the oscillation of the back plate can comprise an angular component of motion whereby the sheets are collected in fanlike part-stacks, a truly translational motion of the back plate in combination with stationary walls of the collecting tray that run parallel with each other will mostly be preferred, since in that way the part-stacks of sheets run parallel with each other whereby their handling may be more convenient.

According to a suitable embodiment of the invention, the reciprocating motion of the sheet-supporting back plate is obtained through a crank-and-slot mechanism, the slot being provided on the back plate and the crank being rotated by an electric motor through a reduction gear.

The apparatus according to the invention may be one in which the copies or prints are collected in facially reversed or inverted relation with respect to their discharge from the apparatus. This permits the sheets to be collected in the tray in correct order relative to the copying or printing sequence. In apparatus of the latter type, the collecting tray is suitably mounted such that the sheets are received at an acute angle with respect to the vertical plane.

The apparatus according to the invention can be used for the collection of large stacks of sheets. As large stacks of sheets are considered in the present specification stacks comprising 500 sheets or more. The collecting of suchlike stacks can raise some problems in case the sheets are collected in facially reversed relation. An apparatus comprising a collecting tray which is arranged in a particular way so that no problems are encountered in this respect is disclosed in EU Application No. 84 200 452.5.

The invention will be described hereinafter by way of example with reference to the accompanying drawings wherein.

Figure 1:
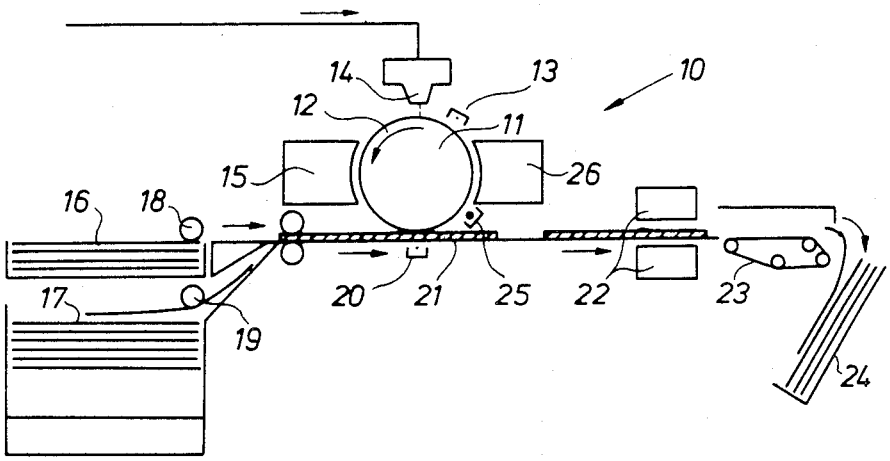
FIG. 1 is a diagrammatic view in side elevation of an electrophotographic printer.

FIG. 1 shows an electrophotographic printer designated generally 10. A photoconductor drum 11 is rotated in the direction of the arrow 12 and uniformly electrostatically charged by corona discharge from a charging station 13. The charged drum is image-wise discharged by appropriate line-wise exposure at exposure station 14 that may comprise a plurality of closely spaced line-wise arranged radiation sources, such as LED's, that are individually energizeable to expose and record the desired image on the drum surface. The dot-wise discharged pattern that remains after the exposure is developed in a developing station 15 containing an appropriate developer with electrostatically charged toner powder that is attracted towards the electrostatic image on the drum. The developed toner image on the drum 11 is transferred to a plain paper sheet fed from either stack 16 or 17 of such sheets. The stack 16 comprises one sheet format, and the stack 17 comprises another sheet format. A dispenser roller 18 or 19 removes each time the upper sheet from a stack, and feeds it in timed sequence towards the drum 11 so that the leading sheet edge coincides with the leading edge of the toner image on the drum. A transfer corona 20 causes the transfer of the toner image of the drum to the paper sheet 21. The sheet is then transported to a fixing station 22 where the toner image is fused into the sheet under the application of heat and pressure. The print is finally removed by a conveyor 23, and received in a collector tray 24. The photoconductor drum is uniformly flooded with light from a rod-like light source 25, and cleaned at a cleaning station 26, so that it is ready for a next printing cycle. It will be understood that the apparatus comprises many other elements known in the art, such as a toner dispenser control system for the control of the correct toner concentration of the developer station, an electric control system for the control of the sequence of the different mechanic operations, an electronic control system including a character generator, a clock signal generator, shift and latch registers, drivers for the LED's, etc. All these components and sub-units of the apparatus are known in the art and irrelevant for the understanding of the present invention, and therefore are not dealt with any further.

Figure 2:
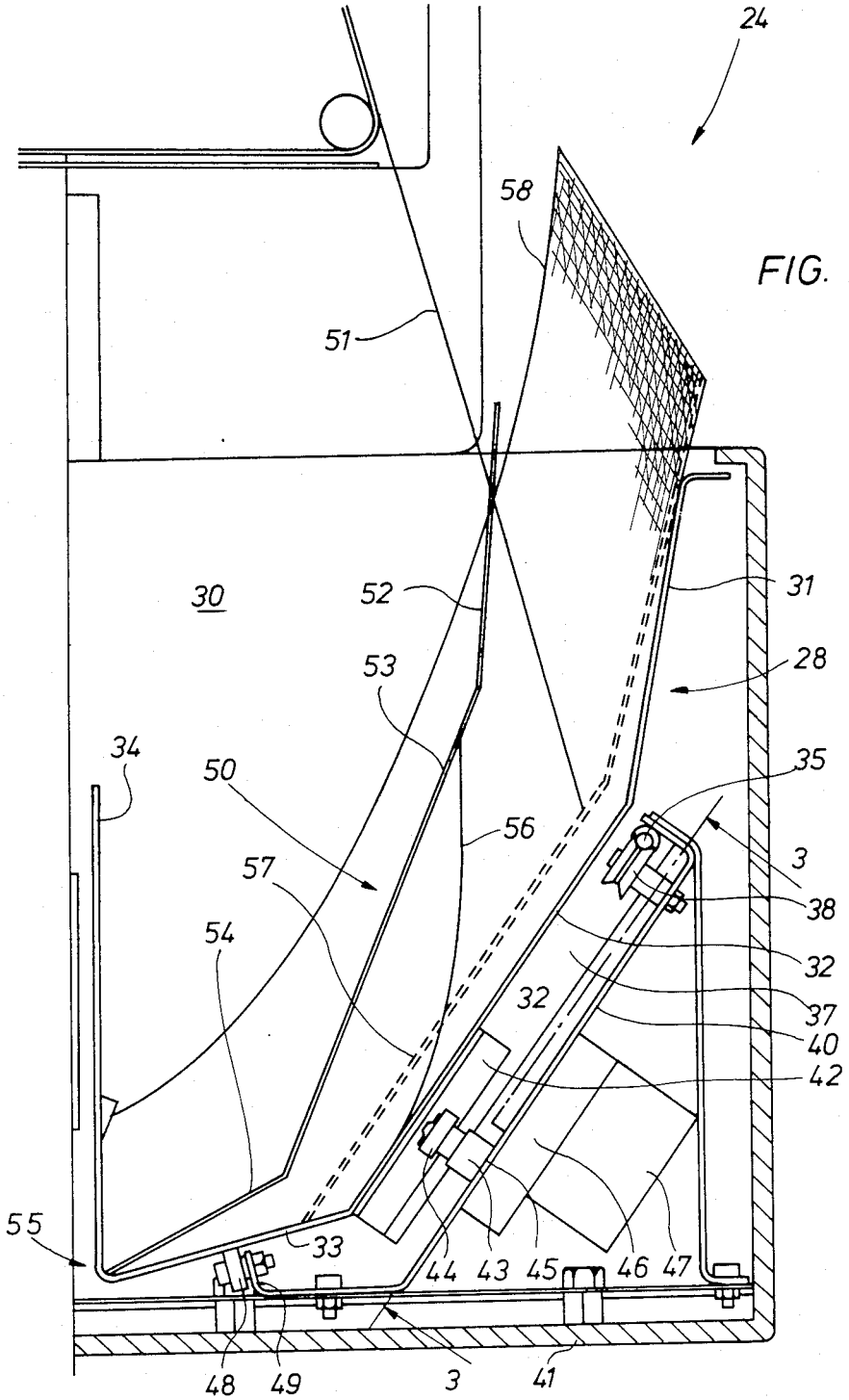
FIG. 2 is an enlarged detail view of the collector tray of the printer of FIG. 1 in side elevation with the walls cut away to reveal its interior.

The collecting tray 24 of the apparatus is illustrated in detail in FIG. 2. The collecting tray is mounted in the rear portion of the apparatus 10 and comprises a base plate 28 that is situated within opposed side walls 29 and 30 of the apparatus, only the wall 30 being shown in FIG. 2. The base plate 28 has three flat sections 31, 32 and 33 that determine a generally concave profile, and an upstanding end section 34. The base plate is arranged for displacement in a direction that is transverse of the apparatus in that it is provided with a rod 35 (see FIG. 3) that is stationarily fitted between two upstanding rims 36 and 37 of the section 32 of the base plate, and that rolls on freely rotatable rollers 38 and 39 that are fitted onto a frame 40 at a nearly 45° position and mounted on the bottom plate 41 of the collector tray.

The base plate is further supported by horizontally spaced freely rotatable rollers such as 48 that are fitted to an angled portion 49 of the framework 40 and onto which the section 33 of the base plate rolls freely.

Figure 3:
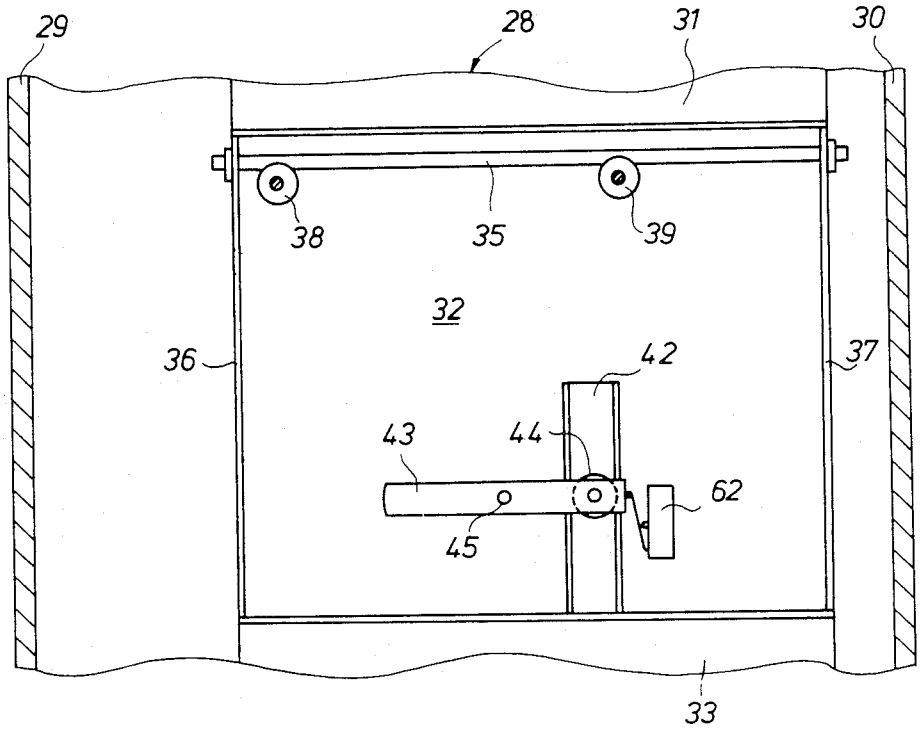
FIG. 3 is a partial sectional view on line 3—3 of FIG. 2, FIGS. 4*a* to 4*f* are diagrammatic illustrations of the formation of the part-stacks in the collecting tray.

The transverse position of the base plate 28, which in FIG. 3 has been shown at the extreme right-hand side, is controlled through a crank-and-slot drive that comprises a U-shaped follower 42 mounted on the section 32 of the base plate 28, and a driver crank 43 with a roller 44 engaging the following 42. The crank is fitted to the shaft 45 of a reduction gear 46 that forms part of an electric motor housing 47.

The way in which the sheets are received in the collector tray by means of a movable sheet-supporting back plate, as disclosed in the application referred to hereinbefore will now be described, but it will be understood that the sheet-supporting back plate may be fixed to the base plate as well, in particular in those cases wherein a smaller number of sheets has to be collected in the tray.

The sheet supporting back plate 50 (see FIG. 2), i.e. the plate onto which the sheets are received and by which the sheets are supported as they leave the discharge port of the apparatus along a generally vertical path 51, comprises sections such as 52, 53 and 54. The plate is hingedly connected to the end section 34 of the base plate at point 55. This connection may occur in any known way such as a by a hinge, by tongues engaging corresponding grooves, etc. The plate is biased at its rearside by leaf springs such as spring 56, that are fixed to the section 32 of the base plate 28 and that bias the plate so that at an empty tray the plate takes a position as illustrated in drawn lines, and at a full tray a position 57 illustrated in broken lines. The upper sheet of a full stack of sheets has been indicated by the line 58, the stack being slightly hatched at the upper side for the sake of clearness. The angle of the back plate 50 relative to the vertical increases under the weight of the sheets stacked thereon, and the advantage thereof is that larger stacks of sheets may be collected without any risk of overturning of the sheets by engagement of their leading ends on the face of the stack, as explained more in detail in the co-pending application referred to hereinbefore.

The formation of the part-stacks of sheets is now described with reference to FIG. 4. At the upper portion of the figure there has been illustrated in plan view the leading end of a sheet 21. Then a transverse section is shown of the sheet supporting back plate 50. Finally there are a number of illustrations similarly in transverse section from a to g of the sheet-supporting back plate and sheets stacked thereon. For the sake of clearness the sheets have not been cross-sectioned.

Referring to FIG. 4*a*, the back plate 50 is shown in the right-hand dead point position, see also FIG. 3, and a sheet 21 that has been discharged along path 51, see FIG. 2, has been received on the back plate as illustrated.

The motor 47 is then controlled to rotate the arm 43 over 360 degrees. After the first 180 degrees of rotation, the back plate has shifted to a left hand dead point position as shown in FIG. 4*b*, and the sheet 21 has been slightly shifted a short distance to the right by abutment against the left side-wall 29 of the collecting tray. After passing through the second 180 degrees of rotation, the back plate is returned to its starting position (FIG. 4*c*). In this Figure, there has been illustrated a next sheet that has been received on top of the first sheet.

A further rotation of the arm 43 over 360 degrees causes the back plate to perform another oscillating motion, whereby after the first 180 degrees rotation of the arm, both sheets have become laterally aligned by abutment against the wall 29 as shown in FIG. 4*d*, and after a next 180 degrees of rotation, the following sheet can be received on the stack. These reciprocating motions of the back plate may go on for each following sheet of the first part-stack of the sheet, it being understood that a following sheet is only delivered onto the stack as the back plate has reached the right-hand position.

After the required number of prints have been made, e.g. 10 prints of page 1 of a document, the next part-stack is formed. The motor 47 is controlled to rotate the arm 43 over 180 degrees, so that the back plate 50 takes the extreme left-hand position and remains there. A new sheet is discharged onto the stack, see FIG. 4*e*, and then the motor is controlled to rotate the arm through 360 degrees. After the first 180 degrees, the back plate has taken a postion as illustrated in FIG. 4*f*, and the upper sheet has been slightly displaced towards the left-hand side by abutment against the right side-wall 30. After the second 180 degrees of rotation of the arm, the plate has regained its new starting position, and a new sheet may be received on the plate. This continues until e.g. 10 prints of page 2 of the document have been received, and then the new starting position of the back plate 50 is as shown in FIG. 4*a*.

The final result is shown in FIG. 4*g*, wherein two part-stacks 60 and 61 are shown. The part-stacks are not only very closely separated from each other, they are also very well aligned individually, and thus the operator need only carefully to remove each part-stack from the collecting tray, whereafter such part-stack may be perforated, stitched, adhered, without further manipulations.

Figure 4:
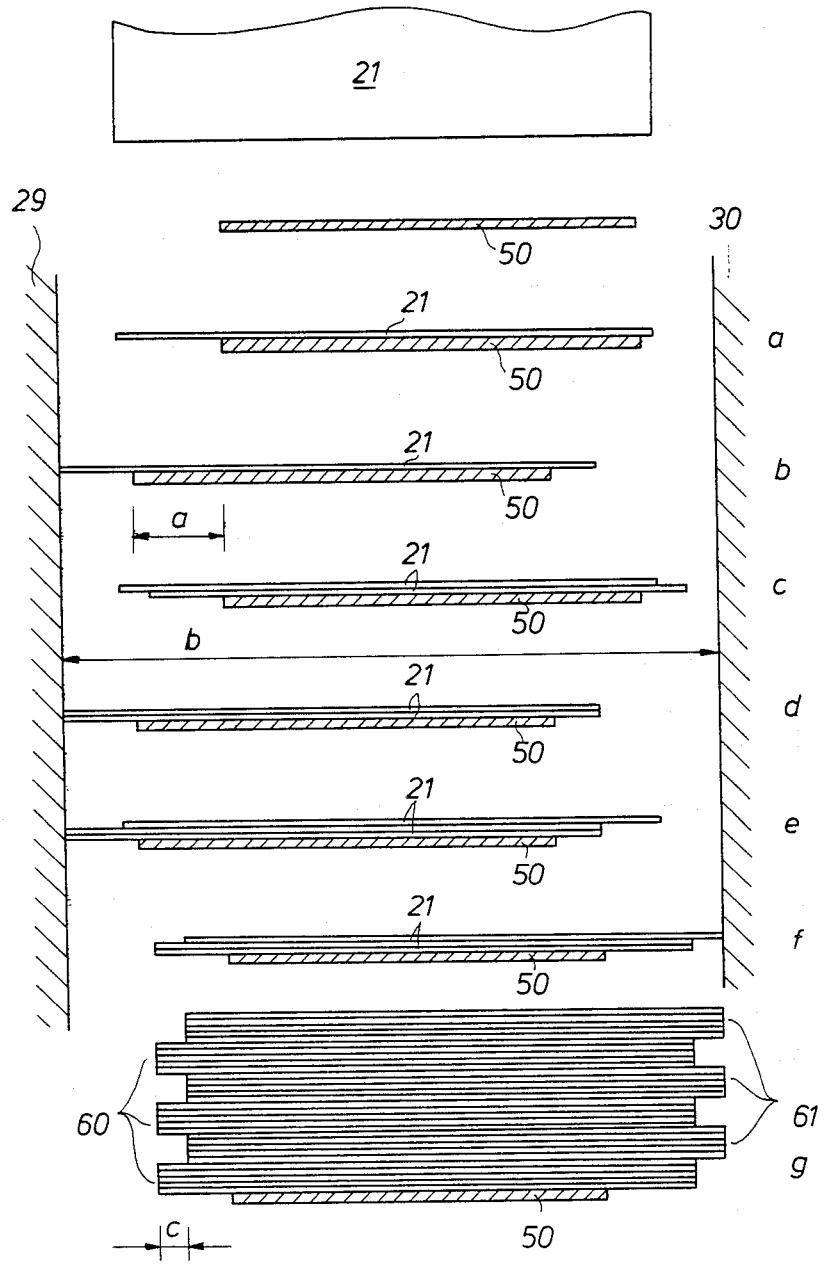

The following data illustrate the apparatus described hereinbefore:

capacity of the collecting tray: 500 sheets A4 (210×297 mm)
width of the sheet-supporting back plate 50: 23 cm
width of the base plate 28: 23 cm
oscillation amplitude: 65 mm (distance a in FIG. 4)
distance between the lateral walls of the collecting tray: 31 cm (distance b in FIG. 4)
staggering of the part-stacks: 35 mm (distance c in FIG. 4)

The control of the rotation of the motor 47 occurs in the apparatus according to the present embodiment as follows. A microswitch 62 is mounted on the plate 32 (see FIG. 3) in such a way that it is switched by the ends of the arm 43 when the arm takes a position such that the base plate 32, and thus also the sheet-supporting back plate 50, is at the left- or right-hand dead point of its oscillating displacements.

Figure 5:
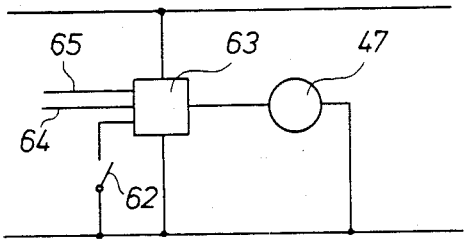
FIG. 5 illustrates the electric control of the oscillation of the sheet supporting plate in the collecting tray.

Referring to FIG. 5, the motor 47 is controlled through a controller 63 which itself is responsive to the switch signals from the microswitch 62, to a signal on input line 64 that determines the left- or right-hand starting position of the back plate 52, and to a start signal on line 65 that is produced by the printer as a print has been discharged from the apparatus. The signal on line 64 is set by the printing apparatus itself. It is not very important whether the initial starting position of the back plate is at the left- or right-hand side. The only critical point is the changing of the starting position each time a part-stack of sheets has been formed.

The period of a reciprocating motion of the back plate must be equal to or smaller than the print time between successive prints.

Although the controller 63 can be a separate element in the apparatus, it will be understood that its function will be performed in practice by the integrated electronic control circuitry of the apparatus that performs also many other functions of the apparatus, such as the control of the number of prints, the control of paper dispensing, the drive of the photoconductor drum, the warning of shortage of supply paper sheets, the signalling of a "full" collecting tray, of paper jam, etc.

The reciprocating displacements of the sheet supporting back plate, via the base plate can be attained through other mechanisms than the illustrated crank-and-slot mechanism.

We claim:

1. Sheet imaging apparatus wherein sheets are taken in succession from a supply stack of sheets, passed through an imaging station wherein an image is formed on the sheets, and then delivered one by one into a collecting tray, and wherein said collecting tray is provided with a sheet-supporting back plate movably mounted for back and forth movement in a direction transverse to the direction of sheet delivery, thereby to produce two part-stacks of sheets in the collecting tray, characterised in that said collecting tray comprises opposed stationary wall means spaced transversely of either lateral side of the sheet-supporting plate, and means for driving the back plate cyclically between transversely spaced dead end points in such a way that at one dead point of the movement a first group of sheets is received one-by-one on the sheet-supporting plate and at the other dead point such sheets are displaced by abutment against the corresponding stationary wall, thereby to form one part-stack of sheets, and that at said other dead point of movement a second group of sheets is received one-by-one on the back plate and at said first dead point said sheets of said second group are displaced by abutment against the corresponding stationary wall, thereby to form the other part-stack of sheets.

2. Sheet imaging apparatus according to claim 1, wherein the opposed stationary wall means of the collecting tray run parallel with each other.

3. Sheet imaging apparatus according to claim 1, wherein the collecting tray is mounted for receiving the sheets in a position that makes an acute angle with respect to the vertical plane.

4. Sheet imaging apparatus according to claim 1, wherein the reciprocating motion of the sheet-supporting back plate is obtained through a crank-and-slot mechanism the slot being provided on the sheet-supporting back plate and the crank being driven by an electric motor through a reduction gear.

5. Sheet imaging apparatus according to claim 4, wherein the crank is in the form of an arm that is fitted in its center on the shaft of the reduction gear, both extremities of which are arranged for co-operation with one microswitch that controls the electric operation of the motor.

* * * * *